US008221148B2

(12) United States Patent
Liu

(10) Patent No.: US 8,221,148 B2
(45) Date of Patent: Jul. 17, 2012

(54) POSITIONING STRUCTURE OF ELECTRICAL CONNECTOR

(75) Inventor: Chung-Peng Liu, Xizhi (TW)

(73) Assignee: T-Conn Procision Corporation, Taipei (TW)

( * ) Notice: Subject to any disclaimer, the term of this patent is extended or adjusted under 35 U.S.C. 154(b) by 0 days.

(21) Appl. No.: 12/960,520

(22) Filed: Dec. 5, 2010

(65) Prior Publication Data

US 2012/0115338 A1 May 10, 2012

(51) Int. Cl.
*H01R 13/62* (2006.01)

(52) U.S. Cl. ..... 439/326; 439/327

(58) Field of Classification Search ..... 439/326, 439/327

See application file for complete search history.

(56) References Cited

U.S. PATENT DOCUMENTS 6,796,825 B2 * 9/2004 Wang ..... 439/326
2002/0072263 A1 * 6/2002 Fumikura ..... 439/327

* cited by examiner

*Primary Examiner* — Ross Gushi

(57) ABSTRACT

The present invention provides a positioning structure of the electrical connector comprising a housing with a slot and a plurality of terminals, at least two side arms positioned on the two side of the housing, every side arm is comprising an extension plate which assembled to the housing, a movable arm and a fixed arm, and the fixed arm has an inserting plate extending downwardly, and at least two positioning sets respectively receiving the side arms. Every positioning set comprises a straight plate and the bent plates respectively positioned on the two sides of the straight plate, a receiving chamber is formed between the bent plates for receiving the inserting plate. Thus by having the bottom portion of the straight plate of the positioning set and every bent plate welded to the circuit board in order to increase the welding area, and to restrict the side arm by every positioning set, thus not only the housing is precisely positioned and also the fine adjustment during the assembling can be implemented; therefore, the present invention provides the convenience for assembling, the stability for welding and accordingly to increase the yield.

8 Claims, 6 Drawing Sheets

POSITIONING STRUCTURE OF ELECTRICAL CONNECTOR

BACKGROUND OF THE INVENTION

1. Field of the Invention

The present invention relates to a positioning structure of the electrical connector, and more particularly the positioning set of the electrical connector that can be securely weld to the circuit board by the bottom portion of the straight plate and every bent plate, and as well as to have restriction to the side arm of every positioning set.

2. Description of Related Art

The conventional electrical connector 6, as shown in FIG. 6, usually has an isolative housing 61, elasticity arms 62 respectively positioning on the two sides of the isolative housing 61, grooves 63 formed respectively at a distal end of every elasticity arm 62, the slots 64 formed respectively underneath the elasticity arms 62, the enhancing elements 65 positioned respectively in every groove 63, the buckling plates 66 respectively inserted in every slot 64, the extension plate 67 respectively positioned vertically at an end of every buckling plate 66, and base plate 68 respectively receiving every extension plate 67. To weld the base plate 68 onto a circuit board (not shown); the isolative housing 61 is joined with the base plate 68 by the extension plate 67 and further the required electronic card is joined to the isolative housing 61 for signal transmission.

Due to the enhancing element 65 and the buckling plate 66 need to be processed twice for assembly before inserting into the groove 63 and the slot 64, therefore the assembly procedure is more complicated; the isolative housing 61 of the electronic connector 6 is formed as a stripe and made of plastic, therefore, deformation can easily occur due to high temperature during the manufacturing process or transportation, thus causes the height differences at the two ends of the isolative housing 61; the height difference can easily cause invalid soldering to the upper end of the isolative housing 61 when joining with the base plate 68, and accordingly to affect the quality of the electrical connector.

SUMMARY OF THE INVENTION

According to an aspect of the present invention, the positioning structure of an electrical connector is invented to overcome the conventional defect by having the bottom portion of the straight plate of the positioning set and every bent plate welded to the circuit board in order to increase the welding area, and to restrict the side arm by every positioning set, thus not only to precisely position the housing and also to enable the fine adjustment during the assembling. Therefore, the present invention provides the convenience for assembling, the stability for welding and accordingly to increase the yield.

According to an aspect of the present invention, the positioning structure of the electrical connector comprises a housing with a slot and a plurality of terminals, at least two side arms positioning on the two side of the housing, every side arm is comprising an extension plate which assembled to the housing, a movable arm and a fixed arm, and the fixed arm has an inserting plate extending downwardly, and at least two positioning sets respectively receiving the side arms. Every positioning set comprises a straight plate and the bent plates respectively positioned on the two sides of the straight plate.

According to an aspect of the present invention, the housing has long openings formed on the two sides to respectively receive every extension plates.

According to an aspect of the present invention, the extension plates have the zigzag portion on at least one side.

According to an aspect of the present invention, a stopper is positioned at the end of the every movable arm without joining to the fixed arm.

According to an aspect of the present invention, a buckling plate is positioned at the conjunction of the every movable arm and fixed arm, and the buckling plate is bent and positioned downwardly and extending from the distal end of the movable arm.

According to an aspect of the present invention, every fixed arm has a bent portion bent outwardly for adapting the inserting plate.

According to an aspect of the present invention, every fixed arm is positioned correspondingly to every movable arm on a side adjacent to the terminals.

According to an aspect of the present invention, every positioning set is welded to the circuit board by the bottom of every straight plate and every bent plate.

According to an aspect of the present invention, a receiving chamber is formed between the bent plates for adapting the inserting plate.

According to an aspect of the present invention, every inserting plate has a through hole, and a hook is positioned on the straight plate corresponding to the through hole.

According to an aspect of the present invention, every inserting plate has a protrusion, and the straight plate has a hole formed corresponding to the protrusion.

BRIEF DESCRIPTION OF THE DRAWING

For more complete understanding of the present invention, reference will now be made to the following detailed description of preferred embodiments taken in conjunction with the following accompanying drawings.

DETAIL DESCRIPTION OF THE INVENTION

Figure 1:
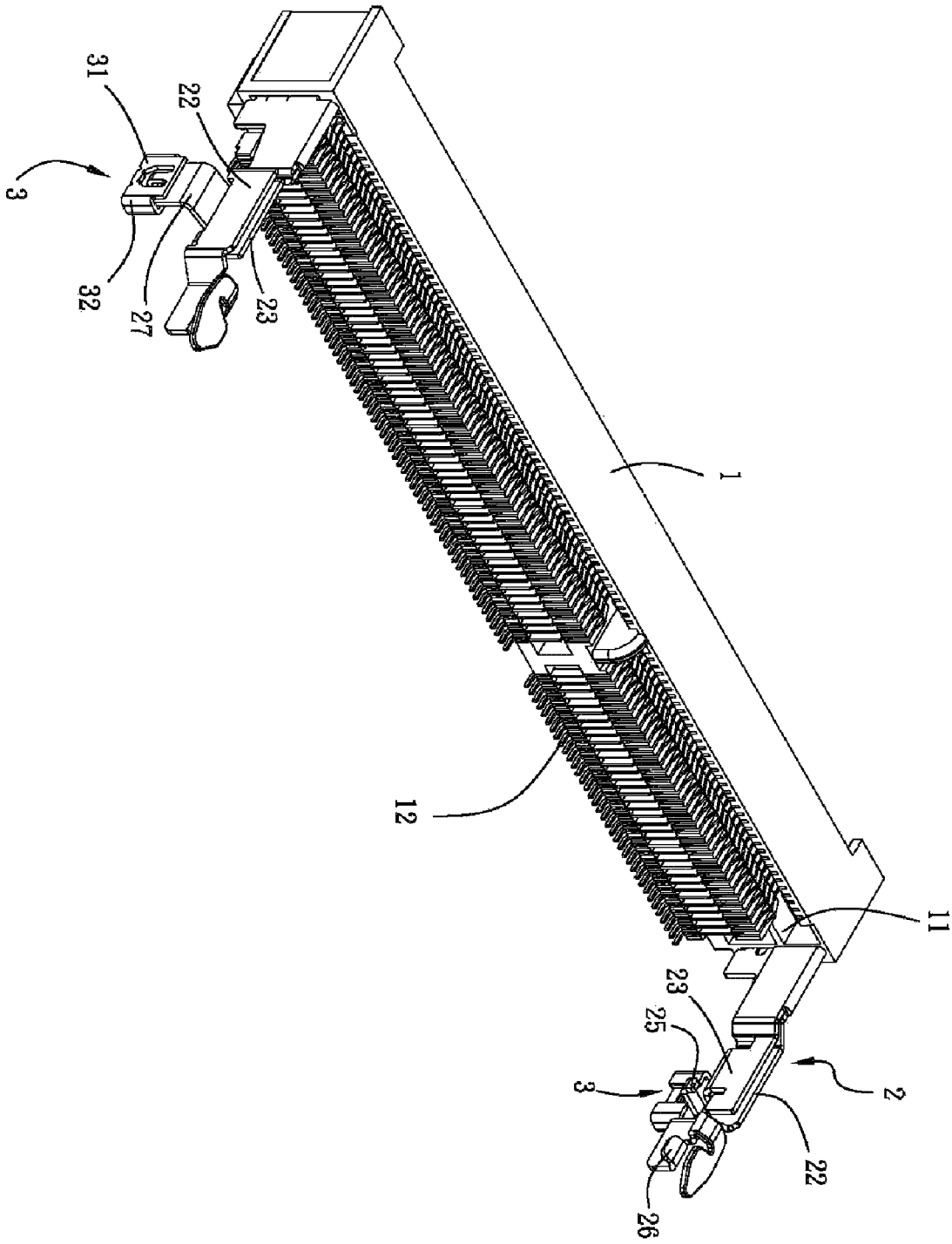
FIG. 1 is an elevational view according to a preferred embodiment of the present invention.
Figure 2:
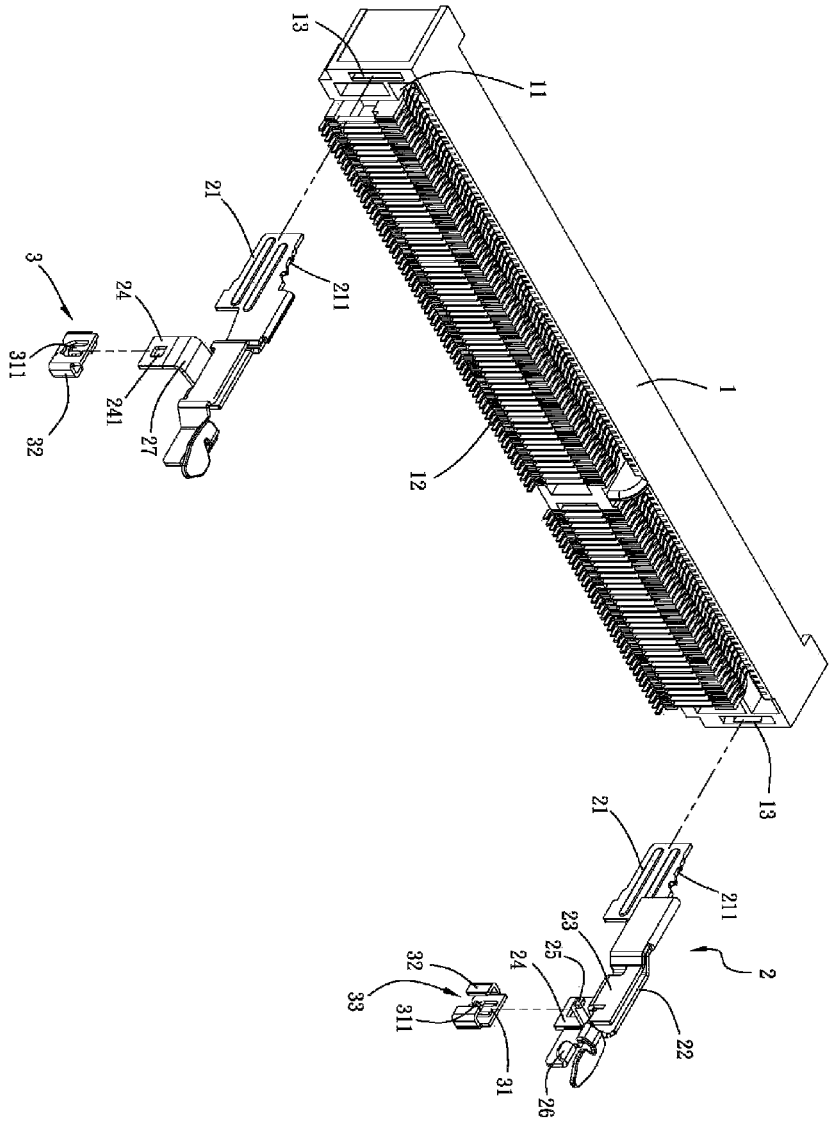
FIG. 2 is an exploded view according to a preferred embodiment of the present invention.
Figure 3:
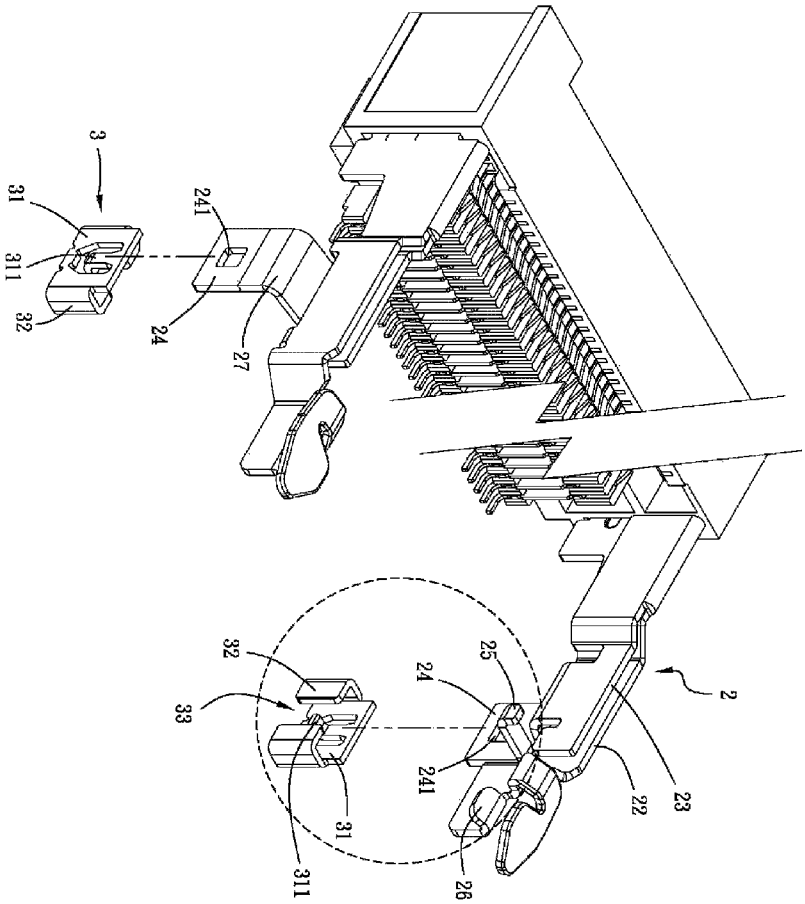
FIG. 3 is a partial aspect of the side arm and the positioning set according to a preferred embodiment of a present invention.

Referring to FIGS. 1, 2 and 3, an elevational, an exploded view and a partial aspect of the side arm and the positioning set according to a preferred embodiment of a present invention, the positioning structure of the electrical connector of the present invention comprises a housing 1, at least two side arms 2 and at least two positioning set 3.

The housing 1 comprises a slot 11 of which having a plurality of terminals 12 positioned on the two sidewalls, and the housing 1 has long openings 13 formed respectively on the two sides. The side arms 2 are positioned on the two sides of the housing 1 and respectively comprise an extending plate 21 adapted by the long opening 13 of the housing 1, a movable arm 22 and a fixed arm 23, the extending plate 21 has at least one side has a zigzag portion 211; at a distal end of the movable arm 22 without connecting to the fixed arm 23 has a stopper 25 and a buckling plate 26 bent and extended downwardly. The fixed arm 23 has an inserting plate 24 extending downwardly from the fixed arm 23, every inserting plate 24 has a through hole 241. The fixed arms 23 of the present invention respectively have a bent portion 27 bent outwards for adapting the inserting plate 24. The extending plate 21, the movable arm 22 and the fixed arm 23 are assembled in a one-piece structure, and every fixed arm 23 is corresponding to every movable arm 22 and positioning on a side of the adjacent terminals 12, in another word, the fixed arm 23 is positioned correspondingly in the inner side to the movable arm 22.

Every positioning set 3 respectively receives every side arm 2, the positioning set 3 comprises a straight plate 31 and bent plates 32 respectively positioning on the two sides of the straight plate 31; a receiving chamber 33 is formed between the bent plates 32, and the straight plate 31 has a hook 311 corresponding to the through hole 241. The inserting plate 24 can have a protrusion (not shown) similar to the hook 311 of the straight plate 31 if needed. The straight plate 31 has a through hole (not shown) to receive the protrusion.

Figure 4:
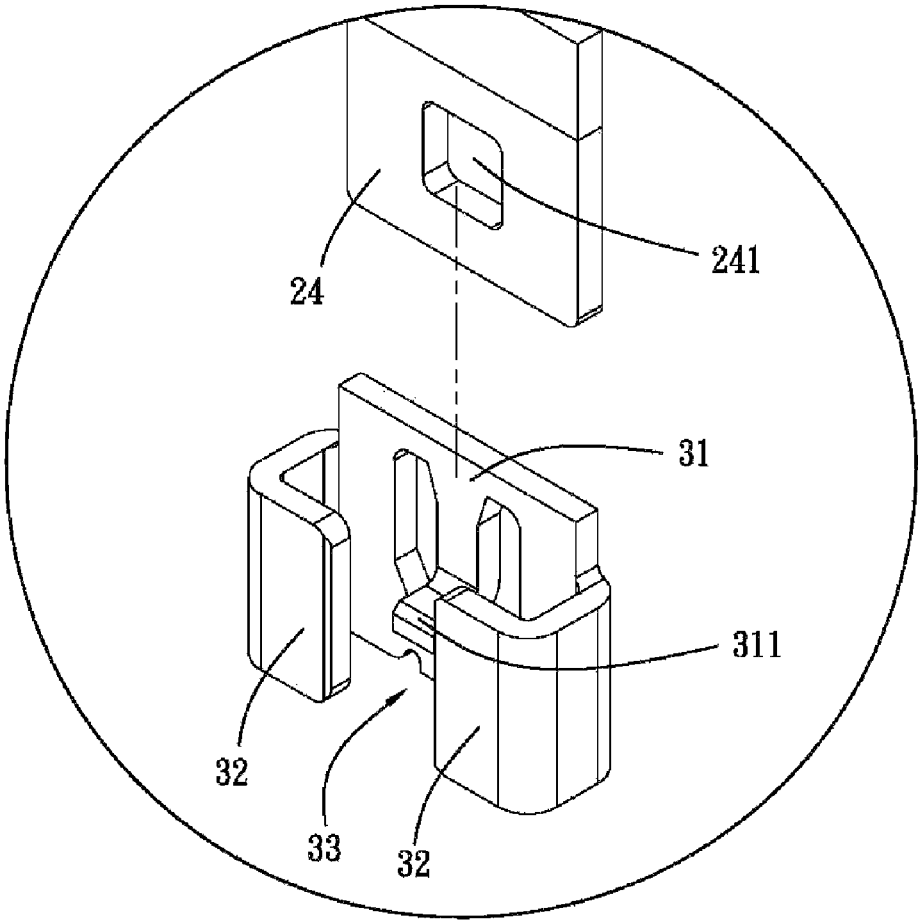
FIG. 4 is an aspect illustrating the insertion of the inserting plate to the positioning set according to a preferred embodiment of the present invention.
Figure 5:
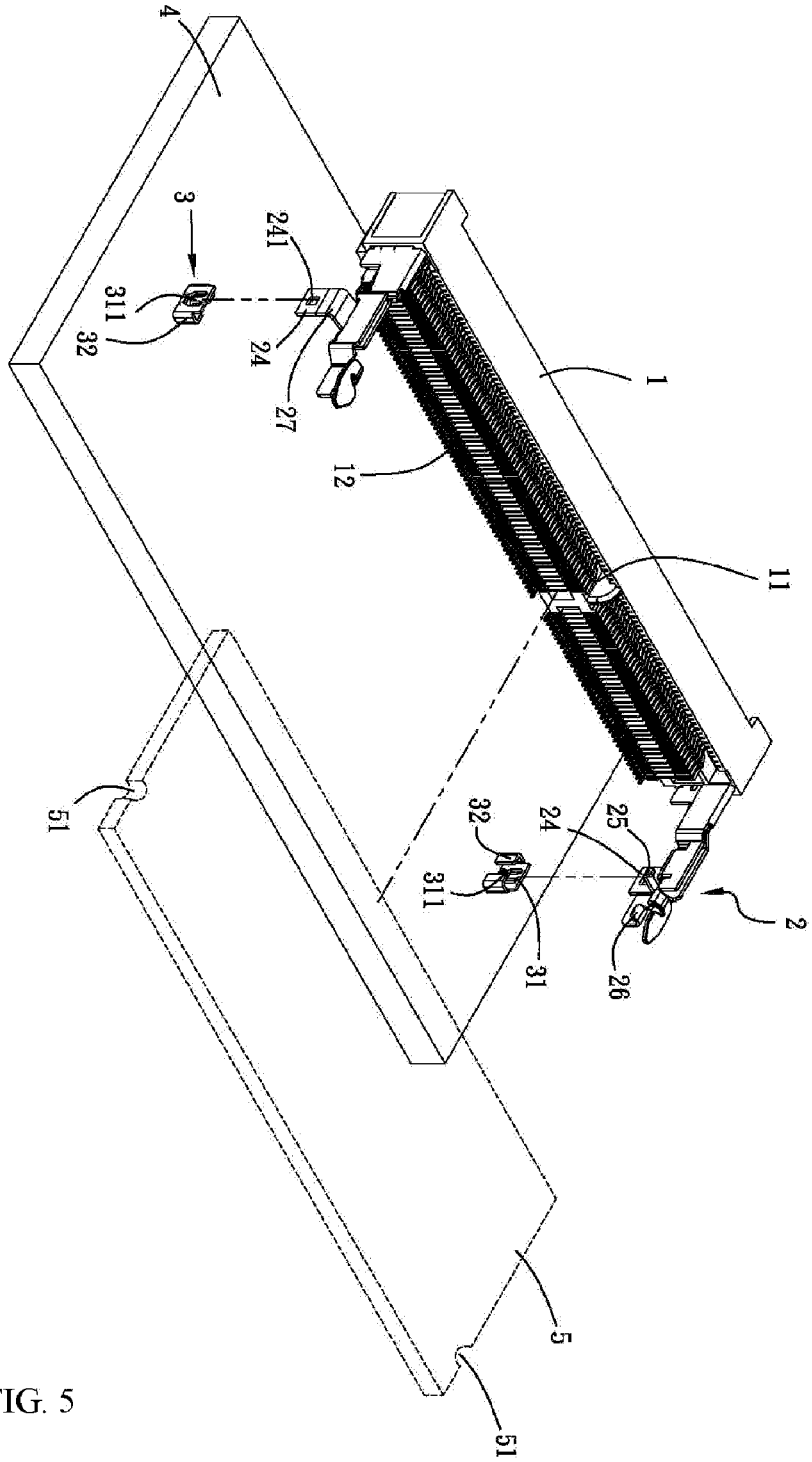
FIG. 5 is an aspect of the assembly of the electrical connector and the electronic card according to an embodiment of the present invention.
Figure 6:
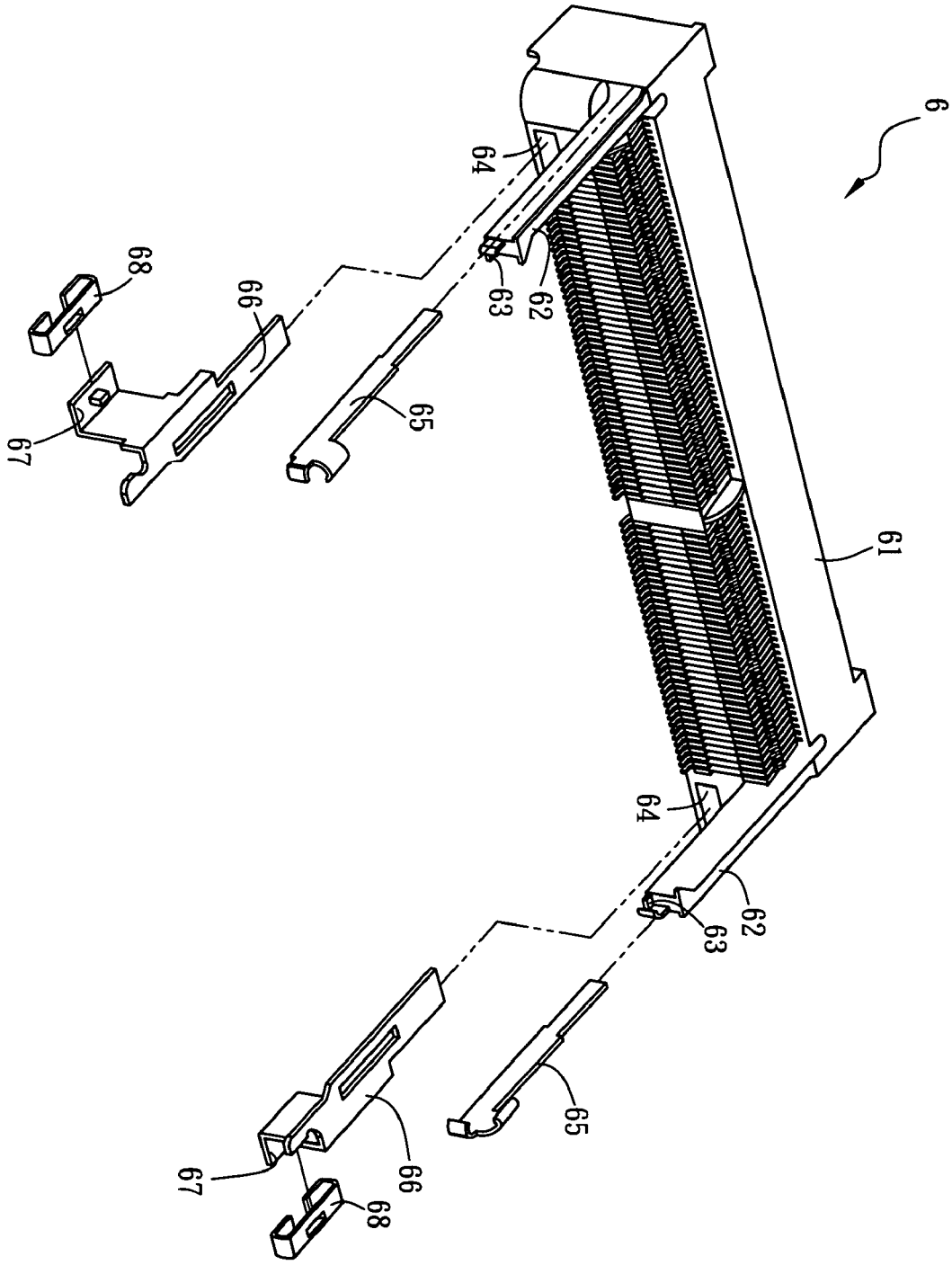
FIG. 6 Prior Art
FIG. 6 is an exploded view of conventional electrical connector.

Referring to FIGS. 4, 5 and 6, to operate the present invention, the extending plate 21 of the side arm 2 is joined to the long opening 13 of the housing 1, the zigzag portion 211 of the extending plate 21 provides barricade in the long opening 13 to prevent the side arm 2 from slipping out of the housing 1; to weld the bottom portion of the straight plate 31 and the bent plate 32 of the positioning set 3 to the circuit board 4. Further, the tri faces of the straight plate 31 and the bent plate 32 are joined to enable the positioning set 3 steadily join thereupon the circuit board 4, then the inserting plate 24 of the side arm 2 is fit into the receiving chamber 33 of the positioning set 3 and further the hook 311 of the straight plate 31 is fit into the through hole 241 of the inserting plate 24, and thus restrict the position of side arm 2 by every positioning set 3. Accordingly, the housing 1 can be precisely positioned on the circuit board 4. Besides, the side arm 2 can move up and down while assembling the housing 1 by fitting the hook 311 into the through hole 241, or to move back and fore, right and left with the correspondence of every bent plate 32 and the inserting plate 24, thus to enable the fine adjustment on the housing 1. The housing 1 can be welded to the circuit board 4 with every terminal 12 thus to provide the convenience of assembly and to upgrade the yield. The related electronic card 5 can be adapted into the slot 11 of the housing 1, the movable arm 22 can be restricted for the right and left movement by the sidewall of the fixed arm 23 and the stopper 25, and the buckling plate 26 of every side arm 2 can be buckled into the semi-rounded indentation 51 formed on the two sides of the electronic card 5, and the terminals 12 can transmit signals thereby.

According to the above description, the present invention substantially provides the novelty by having the positioning set welding to the circuit board with the bottom of the straight plate and every bent plate, by increasing the welding area, the soldering can be steady; to restrict the side arm by every position set not only can precisely position the housing and also to enable fine adjustment while assembling the housing, thus to substantially provide the convenience in assembly and to improve the yield.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A positioning structure of an electrical connector comprising:

a housing, having a slot comprising a plurality of conducting terminals on two sidewalls;

at least two side arms, positioned at two sides of said housing, respectively comprising an extending plate which assembled to said housing, a movable arm and a fixed arm; said movable arm and said fixed arm are positioned in a single-piece structure; said every fixed arm is extending downwardly with an inserting plate, wherein said every fixed arm has a bent portion bent outwardly for joining said inserting plate; and at least two positioning sets, respectively receiving said side arm, comprising a straight plate and bent plates respectively positioning at two sides of said straight plate, wherein said every positioning set is welded to a circuit board by bottom portions of said straight plate and said every bent plate; a receiving chamber is formed between said bent plates for receiving said inserting plate; and to restrict said side arm by every said positioning set enables a fine adjustment while assembling said housing.

2. A positioning structure of an electrical connector according to claim 1, wherein said housing has long openings respectively formed on two sides for joining with every said extending plate.

3. A positioning structure of an electrical connector according to claim 1, wherein said extending plate has a zigzag portion on at least one side.

4. A positioning structure of an electrical connector according to claim 1, wherein said movable arm has a stopper at an end not joined with said fixed arm.

5. A positioning structure of an electrical connector according to claim 1, wherein said movable arm has a buckling plate at an end not joined with said fixed arm, and said buckling plate is bent downwardly from a distal end of said movable arm.

6. A positioning structure of an electrical connector according to claim 1, wherein said every fixed arm is positioned corresponding to said every movable arm and on a side adjacent to said terminals.

7. A positioning structure of an electrical connector according to claim 1, wherein said every inserting plate comprises a through hole, and said straight plate has a hook positioned corresponding to said through hole.

8. A positioning structure of an electrical connector according to claim 1, wherein said every inserting plate has a protrusion and a through hole is formed on said straight plate corresponding to said protrusion of said inserting plate.

* * * * *